United States Patent [19]

Radtke

[11] Patent Number: 4,499,795

[45] Date of Patent: Feb. 19, 1985

[54] METHOD OF DRILL BIT MANUFACTURE

[75] Inventor: Robert P. Radtke, Kingwood, Tex.

[73] Assignee: Strata Bit Corporation, Houston, Tex.

[21] Appl. No.: 535,321

[22] Filed: Sep. 23, 1983

[51] Int. Cl.[3] ..... E21B 9/36; B22D 19/02

[52] U.S. Cl. ..... 76/108 A; 76/101 R; 76/DIG. 11; 76/DIG. 12; 175/329; 175/410; 164/97; 164/108; 29/458; 29/527.6

[58] Field of Search ..... 51/108 A, 108 R, 101 E, 51/101 R, DIG. 11, DIG. 12; 29/458, 527.6, 527.1, 527.2, 527.3; 164/97, 98, 108; 175/329, 410, 393, 409, 411, 374, 375

[56] References Cited

U.S. PATENT DOCUMENTS

| | | | |
|---|---|---|---|
| 1,043,831 | 11/1912 | Heinkel et al. | 76/101 A |
| 1,939,991 | 12/1933 | Krusell | 76/101 A |
| 2,184,776 | 12/1939 | Cottrell | 76/108 R |
| 2,200,281 | 5/1940 | Koebel | 76/108 R |
| 2,260,593 | 10/1941 | Wittlinger et al. | 76/101 A |
| 2,743,495 | 5/1956 | Eklund | 175/410 |
| 3,120,286 | 2/1964 | Bridwell et al. | 175/408 |
| 3,145,790 | 8/1964 | Bridwell et al. | 76/108 R |
| 3,175,260 | 3/1965 | Bridwell et al. | 164/97 |
| 3,513,728 | 5/1970 | Hudson et al. | 76/108 R |
| 4,024,902 | 3/1977 | Baum | 164/97 |
| 4,073,354 | 2/1978 | Rowley et al. | 175/410 |
| 4,098,363 | 7/1978 | Rohde | 175/329 |
| 4,146,080 | 3/1979 | Baum | 164/97 |
| 4,156,329 | 5/1979 | Daniels et al. | 175/329 |
| 4,396,077 | 8/1983 | Radtke | 76/108 A |
| 4,423,646 | 1/1984 | Bernhardt | 76/108 R |

*Primary Examiner*—Roscoe V. Parker

*Attorney, Agent, or Firm*—Burns, Doane, Swecker & Mathis

[57] ABSTRACT

A method is disclosed for the manufacture of a drill bit having a hollow tubular body, or drill bit components, with an exterior tungsten carbide coated surface, and with cutting elements positioned in the cutting surfaces thereof. The drill bit body, or a bit component, such as a cutting blade, is formed by casting in a mold providing the precise dimensions required in the finished bit. The mold is packed or coated over selected portions of the inner surface with particles of sintered tungsten carbide or similar sintered refractory hard metal. The mold has a plurality of soft iron or steel plugs extending from the walls thereof which are of the same diameter as the cutting inserts or passages into the bit body or bit component. A steel alloy, or cast iron, or nodular cast iron, is melted and poured into the mold. The temperature of the molten steel is sufficient to desinter the sintered tungsten carbide particles. The finished casting has the shape of the drill bit body, or bit component, with an exterior surface layer or tungsten carbide. The plugs are then drilled out and the cutting inserts and wear pads inserted in place. The coating extends for a substantial depth, is metallurgically bonded to the steel bit body, or bit component, and protects against wear during drilling for long periods of time.

22 Claims, 16 Drawing Figures

METHOD OF DRILL BIT MANUFACTURE

BACKGROUND OF THE INVENTION

1. Field of the Invention

This invention relates to new and useful improvements in diamond drill bits in which the bit body or a bit component, such as a cutting blade, has a carbide coated exterior surface and more particularly to methods of producing such bit bodies and bit components.

2. Brief Description of the Prior Art

Rotary drill bits used in earth drilling are primarily of two major types. One major type of drill bit is the roller cone bit having three legs depending from a bit body which support three roller cones carrying tungsten carbide teeth for cutting rock and other earth formations. Another major type of rotary drill bit is the diamond bit which has fixed teeth of industrial diamonds supported on the drill body or on metallic or carbide studs or slugs anchored in the drill body.

There are several types of diamond bits known to the drilling industry. In one type, the diamonds are a very small size and randomly distributed in a supporting matrix. Another type contains diamonds of a larger size positioned on the surface of a drill shank in a predetermined pattern Still another type involves the use of a cutter formed of a polycrystalline diamond supported on a sintered carbide support.

Some of the most recent publications dealing with diamond bits of advanced design, relevant to this invention, consists of Rowley, et al. U.S. Pat. No. 4,073,354 and Rohde, et al. U.S. Pat. No. 4,098,363. An example of cutting inserts using polycrystalline diamond cutters and an illustration of a drill bit using such cutters, is found in Daniels, et al. U.S. Pat. No. 4,156,329.

The most comprehensive treatment of this subject in the literature is probably the chapter entitled Stratapax bits, pages 541–591 in Advanced Drilling Techniques, by William C. Maurer, The Petroleum Publishing Company, 1421 South Sheridan Road, P.O. Box 1260, Tulsa, Okla., 74101, published in 1980. This reference illustrates and discusses in detail the development of the Stratapax diamond cutting elements by General Electric and gives several examples of commercial drill bits and prototypes using such cutting elements.

The hardfacing of roller bit bodies with tungsten carbide has been known for many years. Tungsten carbide hardfacing has been applied to the bit body prior to final assembly. Conventional hardfacing techniques, however, require the use of sufficiently high temperatures for application of the tungsten carbide coatings that the metallurgical properties of the steel body may be adversely affected. Attempts have been made to apply tungsten carbide coatings to bit bodies by conventional plasma spraying systems and by explosive-type coating methods. Such systems produce only very thin coatings and either do not adhere to the steel surface adequately or are too thin to withstand the severe conditions encountered in earth drilling.

Hardfacing of drilling tools, including tool joints, drill collars and rotary cone bits is found several places in the patent literature and summary of the art as of about 1970 is given in History of Oil Well Drilling, J. E. Brantly, Gulf Publishing Co., 1971, pp. 1028, 1029, 1081.

The patent literature includes a number of instances of tungsten carbide components being molded into a finished object.

Baum U.S. Pat. No. 4,146,080 discloses a composite material consisting of a refractory metallic carbide particles in a local matrix alloy having a lower melting point in the carbides. These composites are prepared by placing sections of refractory metallic carbide, at least some of which are larger in size than those desired in the final composite, in a mold. Matrixing alloy is heated above the melting temperature of the binder metal employed in this sintered carbide and then poured into the relatively cold mold. The binder metal dissolves and leaves the outer surfaces of the sections and diffuses into the alloy which is allowed to cool naturally and solidify. The final composite contains micron size particles of the carbides that are released from the large section when the binder melts.

Baum U.S. Pat. No. 4,024,902 discloses composites consisting of sintered tungsten carbide particles in a matrix of a steel alloy having carbon, cobalt and tungsten content which are prepared by placing particles of tungsten carbide with cobalt binder, at least some of which are larger in size than those desired in the final composite in a mold. Matrixing alloy having little or no tungsten content is heated above its melting temperature and then poured into the relatively cold mold. The carbon, tungsten and cobalt dissolve at the outer surfaces of the particles and diffuse into the alloy which is allowed to cool naturally and solidify.

The Baum patents disclose the use of the described process in the preparation of composite articles, including coated articles, containing tungsten carbide, or other refractory hard metal, for hardness and abrasive wear.

Bridwell U.S. Pat. No. 3,175,260 discloses the preparation of a composite casting by casting a matrix metal into a mold having carbide particles packed along two sides of the mold to provide a shaped metal body coated with the refractory carbide. The process is described as being useful for refractory hard metals in general, including tungsten carbide, titanium carbide, tantalum carbide, niobium carbide, etc. Binder metals include the iron group metals.

Bidwell U.S. Pat. No. 3,145,790 discloses the formation of refractory metal carbide coatings in the form of a layer on drag bits and also on the bit bodies of a drag bit.

Bidwell U.S. Pat. No. 3,120,286 discloses another drag bit having hard facing formed thereon.

Krussel U.S. Pat. No. 1,939,991 discloses a diamond cutting tool in which the tool body is of a sintered refractory carbide or other hard metal.

Heinkel U.S. Pat. No. 1,043,831 discloses casting a cutting wheel with metal cutters being provided in the form of inserts secured in the mold. The inserts are incorporated into the cutting wheel.

Cottrell U.S. Pat. No. 2,184,776 discloses the casting of a bit body around hard metal, i.e. refractory carbide cutting inserts.

Eklund U.S. Pat. No. 2,743,495 discloses production of a composite cutter in which a bit body is molded or cast around carbide inserts.

Koebel U.S. Pat. No. 2,200,281 discloses molding cutters of sintered hard metal as supports for diamond cutting elements.

Wittlinger U.S. Pat. No. 2,260,593 discloses molding sheets of carbide material onto the surface of cast tooth pipe cutter.

The prior art teaches the use of tungsten carbide and other sintered refractory hard metal coatings for hardening and protection against abrasive wear in various types of tools including various drill bits. Prior art such as Bidwell U.S. Pat. No. 3,175,260 and Baum U.S. Pat. Nos. 4,024,092 and 4,146,080 disclose the desirability of molding composite objects, including bit bodies, having wear resistant refractory carbide surfaces.

Drill bits using diamond type cutters supported on steel bit bodies cannot utilize the technique of casting the bit body with a refractory carbide coating in place because the temperature of the mold metal is considerably higher than can be tolerated by the diamond cutting inserts. Some efforts have been made to provide refractory carbide or other hard metal coatings on bit bodies for diamond type cutters by use of various hard facing techniques and these processes have been thoroughly unsatisfactory in that the temperature of the diamond cutters is raised above the point at which the cutters are damaged. There has been a substantial need for a diamond drill bit having the surface of the bit body completely coated with a refractory hard metal such as sintered tungsten carbide. The refractory hard metal, e.g. tungsten carbide, coating cannot be applied over the entire surface of the bit body at the time the bit body is cast since the hard coating makes it virtually impossible to drill the bit body for addition of the cutting elements, wear pads, and other drill bit components. Consequently, the need for a diamond drill bit having the surface of the bit body completely coated with tungsten carbide or other refractory hard metal continues and has not been solved by the prior art.

SUMMARY OF THE INVENTION

One of the objects of this invention is to provide a new and improved method for the production of a drill bit having an exterior surface coated with tungsten carbide, or like hard metal, with diamond cutting inserts therein.

Another object is to provide an improved method of casting drill bit bodies and bit components and simultaneously coating the same with tungsten carbide.

Another object is to provide a method of casting a drill bit body or a bit component and coating the same with tungsten carbide which leaves selected areas uncoated to permit drilling to provide recesses for the diamond cutting elements.

Other objects and features of this invention will become apparent from time to time throughout the specification and claims as hereinafter related.

The foregoing objectives are accomplished by casting the bit body or bit component in a mold providing the precise dimensions required in the finished bit or component. The mold is coated over substantially its entire inner surface with particles of sintered tungsten carbide or similar sintered refractory hard metal. The mold has a plurality of soft iron or steel plugs extending from the walls thereof which are of the same diameter as the cutting inserts. A steel alloy, or cast iron, or nodular cast iron, is melted and poured into the mold. The temperature of the molten steel, or molten iron, is sufficient to melt part of the binder metal of the sintered tungsten carbide. When solidified, the casting has the shape of the drill bit body or bit component with an exterior surface layer of tungsten carbide or other hard metal. The soft iron or steel plugs are then drilled out and the cutting inserts and wear pads inserted in their respective locations. This process coats the steel bit body with tungsten carbide without coating or otherwise affecting the cutting inserts. The coating is metallurgically bonded to the steel bit body or bit component and protects against wear during drilling for periods of several hundred hours.

DESCRIPTION OF ONE PREFERRED EMBODIMENT

Figure 1:
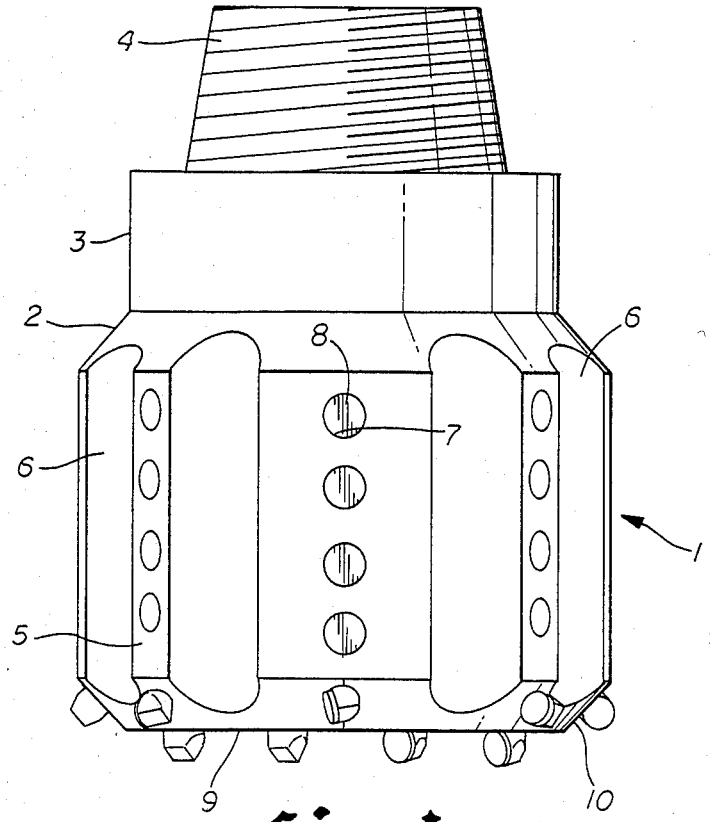
FIG. 1 is a view in side elevation of an earth boring drill bit with diamond-containing cutting inserts and carbide wear pads having a tungsten carbide surface produced in accordance with a preferred embodiment of this invention.

In the following description, unless otherwise noted, the general description of the drill bit is that of the applicant's prior pending applications, viz. Ser. No. 220,306, filed Dec. 29, 1980, Ser. No. 158,389, filed June 11, 1980, Ser. No. 296,811, filed Aug. 27, 1981, Ser. No. 303,721, filed Sept. 21, 1981, and Ser. No. 303,960, filed Sept. 21, 1981.

In the manufacture of earth drilling bits having diamond cutter inserts, the drill bit body is cast into the desired shape, machined to the desired external dimensions, and holes or recesses are provided into which the diamond insert cutters and the wear pads or tungsten carbide inserts are pressed. A variety of diamond insert type earth drilling bits have been available commercially but all are subject to the problem of excessive wear of the bit body by the erosive force of the drilling mud and the rock cuttings produced by the bit during drilling operation. In fact, the problem of bit body erosion is so severe that the bit bodies often erode to the point where cutters and nozzles are lost before they are worn out. There has been a substantial need for an improvement in the bit bodies to provide for increased wear to the point where the bit body does not wear out before the diamond insert cutters.

The most obvious attack on this wear problem would be to provide some form of hard facing similar to that used in protecting the surface of roller cone bit bodies. Diamond insert bits, however, cannot be coated by conventional hardfacing techniques. The hard facing cannot be applied by conventional hard facing techniques after the diamond insert cutters have been assembled since the treating temperatures that are involved can damage the cutters and can cause distortion in the bit body itself. Many attempts have been made to coat the bit bodies before assembly of the cutters with a thin a layer of tungsten carbide applied by either a plasma spraying system or by an explosive gun-type coating system.

Some of these techniques have had some limited degree of success but are expensive and require a separate operation in the manufacture of the drill bit body. As noted above, in the discussion of the prior art, there have been some techniques available for molding various types of tools and forming tungsten carbide coatings in the molding process. None of these procedures have been used as described herein. Also, the procedures which provide for the application of tungsten carbide coatings during the molding process do not take into account the necessity of providing holes for the drill bit nozzles and recesses for the diamond insert cutters and the tungsten carbide wear pads or inserts which are used on the stabilizer face of the bit body.

This invention is therefore concerned with an improved process for the formation of a drill bit body (or other shaped body) having holes or recesses in the finished product which provides for the application of a tungsten carbide (or other sintered hard metal) coating over the entire surface of the body while leaving selected areas free for machining holes or recesses in the body.

Figure 2:
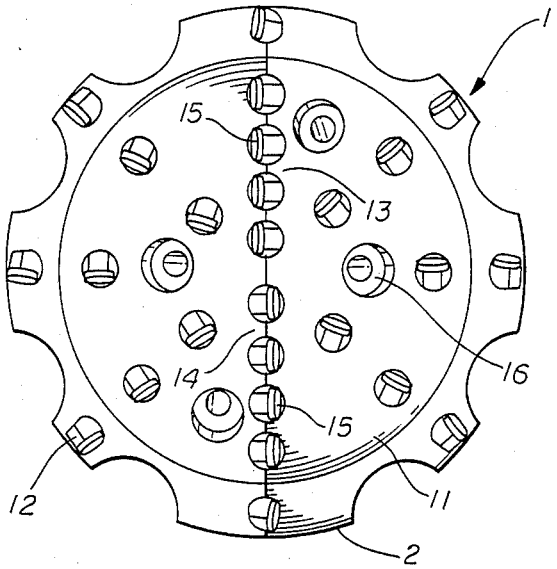
FIG. 2 is a plan view of the bottom of the drill bit shown in FIG. 1.

Referring to the drawings by numerals of reference and more particularly to FIGS. 1 and 2, there is shown a drill bit 1 which comprises a bit body 2 which, when finished, is adapted to be connected by a threaded connection to a drill collar in a conventional drill string. The body 2 is formed of cast iron, nodular cast iron, or any suitable steel alloy, especially a high temperature alloy steel. The bit body 2 has an upper portion 3 having a tapered portion 4 which, in the finished form, is threaded for connection to a drill collar.

The upper portion 3 and threaded tapered portion 4 may be formed as a separate piece and welded to the lower portion of the bit body 2. This is often done where it is necessary to machine a larger cavity inside the bit body 2 than can be conveniently done through the hollow passage in the upper portion 3 and threaded portion 4. The bit body 2 has a longitudinally extending passage (not shown) which terminates in a cavity (not shown) in the lower portion of the body. The upper portion 3 may be machined to provide wrench slots, or the like, or may be machined to any suitable configuration as required for handling the finished product.

The main portion of the bit body 2 has an outer stabilizer surface 5 with a longitudinally extending slots 6 therein. The stabilizer surface 5 is provided with a plurality of recesses 7 in which there are positioned tungsten carbide inserts or wear pads 8. The lower end face 9 of bit body 2 is preferably of a crown structure which is tapered at the outside as indicated at 10 and on the inside as indicated at 11 in FIG. 2. The lower cutting face 9 of bit body 2 is provided with a plurality of diamond insert cutters 12 having a configuration as shown in applicants prior applications referred to above.

In this particular design of drill bit, the lower end face 9 is provided with a radially extending ridges 13 and 14 from which there extend a plurality of diamond insert cutters 15. These cutters have the diamond inserts supported squarely on the end of supporting tungsten carbide studs instead of at an angle as in the insert cutters 12. The cutters 15 are designed for a more direct shearing action on the bottom of the hole and are particularly useful in drilling through firmer rock formations. The lower end face 9 of bit body 2 is also provided with a plurality of angularly extending nozzle openings 16 which extend into the inner cavity (not shown) of the lower bit body portion. Passages 16 are arranged ton receive removable nozzle members which may be constructed as described in applicant's prior co-pending applications referred to above.

In the construction of a drill bit of the type just described, it would be highly desirable to provide a heavy tungsten carbide coating over the lower cutting face 9 and the stabilizer surfaces 5 as well as the junk slots 6. As previously noted, it is difficult to apply hard facing to a bit body either before or after installation of the insert cutters and wear pads. The process or method which comprises this invention provides a means to produce a drill bit body having a coherent layer or coating of tungsten carbide (or other sintered hard metal) which is formed during the casting of the bit body. For convenience in understanding the method, the details of the mold for casting the bit body and the various physical steps involved in the preparation of the bit body will be described first and then specific examples will be given of the preparation of a bit body in accordance with the improved method.

Figure 3:
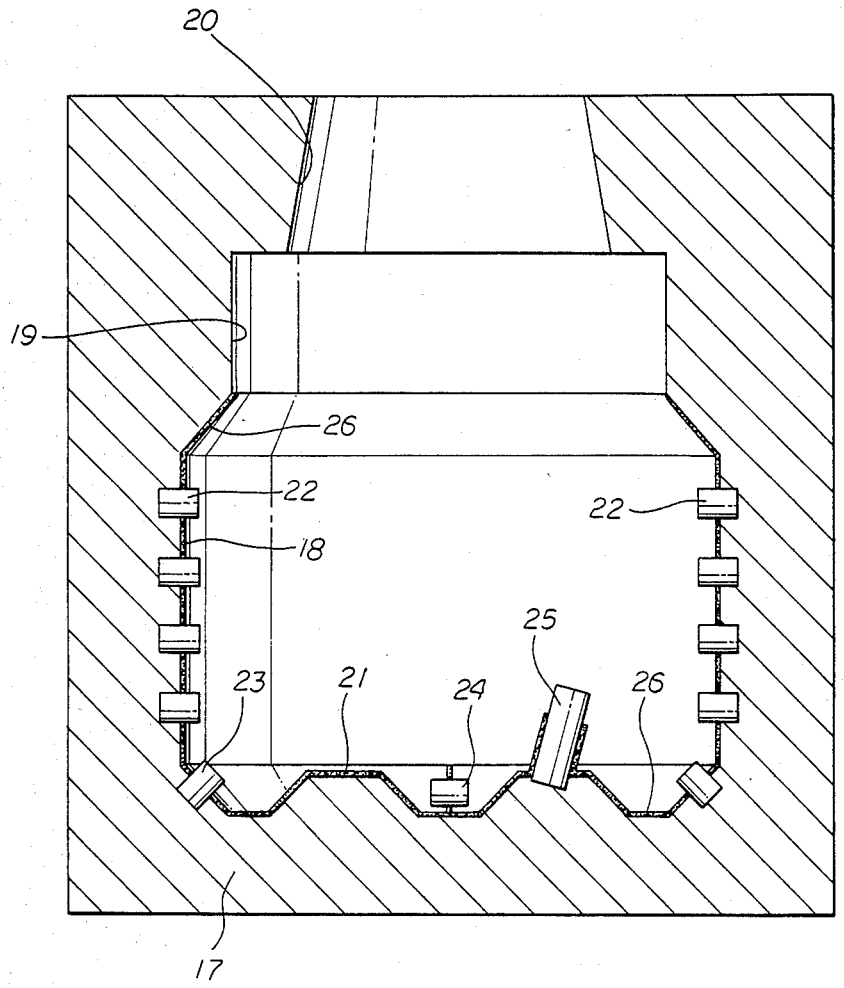
FIG. 3 is a longitudinal sectional view taken normal through a mold for casting the bit body for the drill bit shown in FIGS. 1 and 2.

In FIG. 3, there is shown a mold 17 into which the bit body 2 is cast. Mold 17 has a hollow lower cavity 18 which has an internal configuration corresponding to the lower bit body portion, and an upper cavity 18 and 19 corresponding to the upper bit body portion 3 and tapered portion 4, respectively. The bottom 20 of mold 17 has a configuration corresponding to the end face or bottom end of drill bit 1. A plurality of relatively soft metal plugs 22, e.g. a soft or mild steel, are positioned in the side walls 18 of the mold cavity in locations corresponding to the recesses 7 in the drill bit stabilizer surface which receive the inserts or wear pads 8.

In the bottom wall 21 of the mold cavity there are a plurality of soft steel plugs 23 and 24 which are positioned to correspond in location to the recesses which receive cutter inserts 12 and 15, respectively. The bottom wall 21 of the mold cavity also has soft steel plugs 25 which are positioned to correspond to the nozzle openings 16 in the bottom end face of the drill bit. The mold cavity is coated with a layer 26 of a particulate hard facing material. A particulate material is of a sintered hard metal, e.g. fine or coarse particles of sintered tungsten carbide, and is provided as a coating or packing around the entire wall of the lower portion of the mold cavity. The coating of tungsten carbide particles 26 covers the entire wall of the cavity and surrounds various steel inserts 22, 23, 24 and 25.

The iron, or steel alloy for bit body 2 is melted and brought to a temperature about 200° above its melting point which is sufficient to melt the matrix metal of the sintered hard metal particles which form the layer 26 inside the mold cavity. When the molten metal is poured into the mold cavity it fills the cavity to produce a casting which corresponds precisely to the required dimensions of the bit body 2. Alternatively, the metal for the main portion of the bit body may be provided as a metal power and melted in place by induction heating.

The portion of the molten metal which contacts the layer 26 of particulate sintered hard metal, e.g. sintered tungsten carbide, causes the matrix metal to partially melt an alloy with the molten metal to form the drill bit body. The layer 26 of particulate hard metal therefore becomes an integral part of and forms a composite structure with the bit body. This layer of particulate hard metal extends for an appreciative depth into the outer surface of the bit body and provides a surface which is wear resistant for a long period of use of the resulting drill bit. When the bit body 2 is removed from the mold, it is in the form shown in FIG. 4. Because of the angular location of some of the steel plug inserts, it is necessary to break the mold apart to remove the casting.

Figure 4:
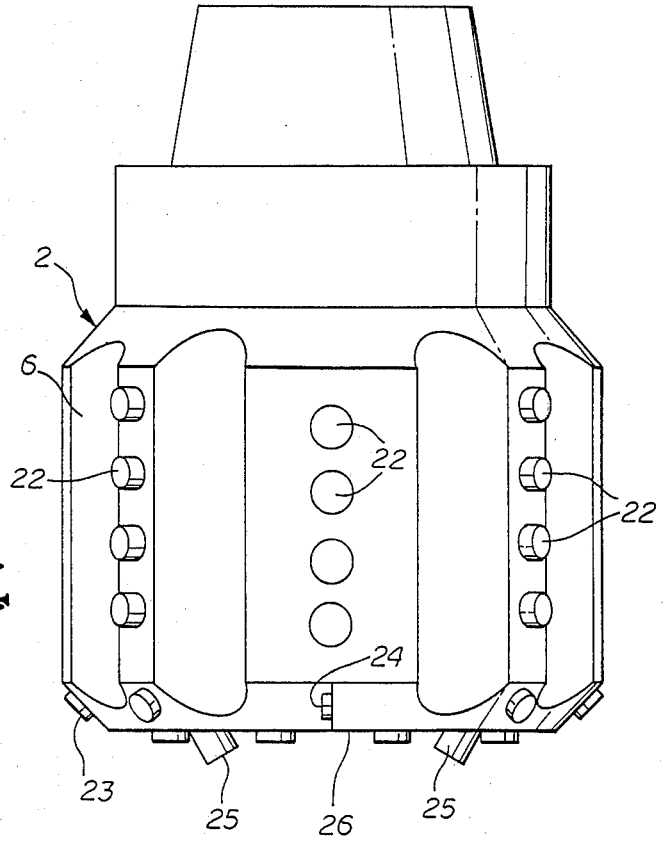
FIG. 4 is a view in side elevation of the bit body produced in the mold shown in FIG. 3 before the plugs are drilled out to permit installation of the cutting inserts and wear pads.

In FIG. 4, it is seen that steel plugs 22, 23, 24 and 25 have been incorporated into the structure of the bit body. The layer 26 of particulate hard metal surrounds the soft steel plugs but does not coat them. The soft steel plugs therefore provide soft openings through the hard layer 26 of particulate hard metal. The soft steel plugs 22–25 are then drilled out to provide recesses for the wear pads or inserts 8 and the diamond insert cutters 12 and 15, as well as providing for the openings 16 for the removable nozzles. The apertures which are formed in the bottom end face of bit body 2 by drilling out steel plugs receive the diamond insert cutters 12 and 15. The apertures produced by drilling out steel plugs 25 receive removable nozzles 27.

Figure 5:
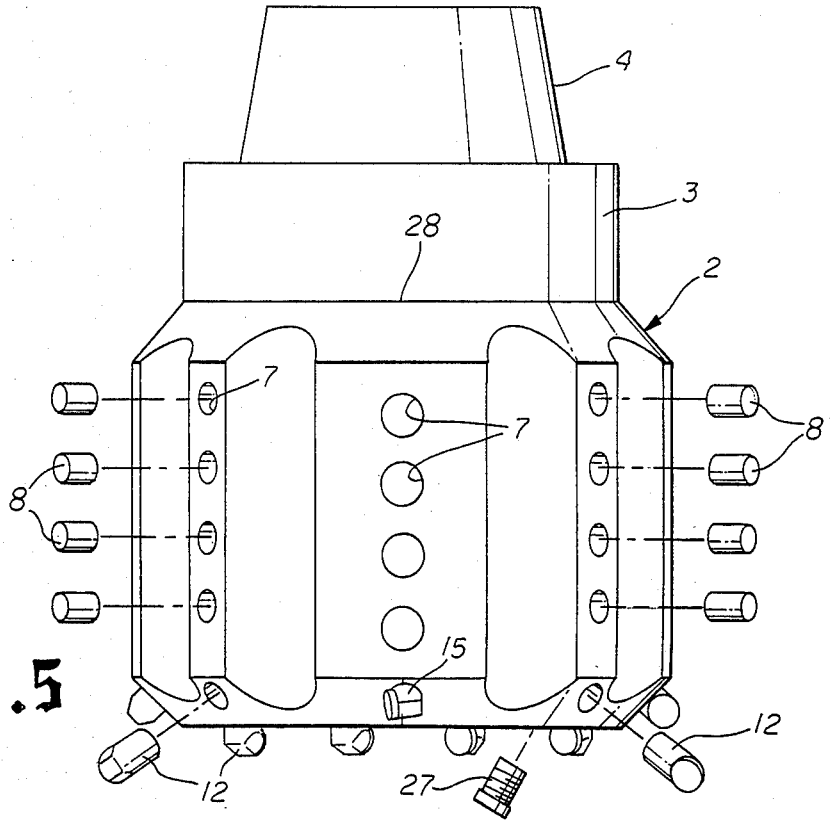
FIG. 5 is a view in side elevation of the bit body produced in the mold shown in FIG. 3 after the plugs are drilled out and showing the cutting inserts and wear pads in exploded relation to the drilled recesses in the bit body.

The view of the drill bit body, as seen in FIG. 5, shows the bit body 2 after casting and drilling out the various steel plugs and shows the wear pads 8, the diamond insert cutters 12 and 15, and the removable nozzles 27 in exploded relation to the bit body 2 before assembly therein. As previously noted, the lower portion of the bit body 2 below the line 28 can be cast as a separate member and the upper portion cast separately and secured thereon by welding as in prior art drill bit constructions, particularly as shown in the prior patent applications of this applicant.

In the example below, the specific details are given of the materials used in casting the drill bit body and in forming the coating of particulate hard metal 26, as well as some of the temperature conditions utilized in the casting. In this application, the term particulate hard metal or particulate sintered hard metal refers to any of the classes of materials called "hard metals" in the metallurgical literature. Hard metals are refractory compounds of heavy metals such as tungsten, tantalum, uranium niobium, etc. In particular, the carbides, nitrides, silicides, oxides, and borides of these heavy metals have the refractory properties of hardness which cause the entire group to be known to metallurgists as hard metals. These materials are generally prepared in a finely particulate form bound by a suitable matrix metal, such as an iron group metal, viz. iron, cobalt or nickel. Sometimes, copper and silver have been used as a matrix metal for the hard metals. In carrying out this invention, the examples used primarily particulate, sintered tungsten carbide, but it should be understood that equivalent particulate forms of the other hard metals could be used.

In the following example, it should be noted that tungsten carbide will dissolve in any iron alloy at 2650° F. or higher, which is the practical sintering temperature. Accordingly, while the alloy has a temperature above about 2650° F. and has infiltrated the particles, the surfaces of the particles will dissolve into the alloy and fuse therein. This dissolving continues until the matrix cools below 2650° F. or the sintered material is completely dissolved. In this example, it is necessary to use tungsten carbide particles having a volume and surface areas such that they will not be completely dissolved before the matrix solidifies. This may involve the use of some larger sintered particles in the mold which only partially dissolve before the matrix solidifies. Alternatively, a larger quantity of smaller particles may be used which only dissolve partially before the casting alloy solidifies.

EXAMPLE I

In this example, mild steel plugs are placed in the mold as described for FIG. 3. Next, 20/30 mesh sintered tungsten carbide particles are coated around the entire inner surface of the mold cavity with a coating surrounding the various mild steel plugs. Sufficient alloy steel to fill the mold cavity is then melted and heated to a temperature of about 3100° F. (temperatures in the range from 2800° to 3200° F. may be used) and poured into the molds. The mold is a sand mold (graphite molds may also be used) and at room temperature at the time of casting. The mold is filled with the molten alloy steel and allowed to cool naturally for about one (1) hour. Afterward, the mold is broken away from the casting and the casting subsequently quenched and then tempered.

The surface coating of the casting which comprises the bit body 2 is of sintered particles of tungsten carbide which are a fine particle size as a result of partially dissolving into the molten metal of the bit body. The metal matrix which extends between the individual tungsten carbide particles is an alloy steel containing additional tungsten and carbon from the composition of some of the tungsten carbide and a small amount of the matrix metal, which here is cobalt. When the steel plugs are drilled out as described above, the various components of the drill bit may be placed in their desired location and the finished drill bit thus produced.

The drill bit body which is produced in this example has the strength and high temperature properties of an alloy steel in the main body portion thereof. The main surface layer has the properties of the fine particles of tungsten carbide with the matrix alloy extending throughout the spaces between the tungsten carbide particles. The overall structure is a composite which varies in construction from the surface layer which is primarily tungsten carbide particles through somewhat varying composition which becomes progressively more dilute and joins into the main body portion which is alloy steel modified by a small amount of dissolved tungsten. The surface of the bit body will typically have a hardness of 70–90 RC.

While the process has been described as using ordinary commercially available tungsten carbide particles, it should be noted that the carbides used may also be reclaimed carbides from spent or used hard metal products. For example, sintered carbide cutters, inserts and the like can be crushed to a fairly coarse powder and used as the coating material. This carbides may include carbides of tantalum, titanium, or the like as well tungsten carbides. When coarser carbide particles are used, it is usually necessary to heat the molten alloy steel to a somewhat higher temperature so that more of the carbide particles will be dissolved before the steel solidifies.

EXAMPLE II

In this example, the mold is coated with a mixture of coarse particles of sintered tungsten carbide obtained by reclaiming scrap cutter inserts and fine particles of sintered tungsten carbide. The tungsten carbide particles attack into a substantial layer around the entire enter surface of the mold and surrounding the mild steel plugs which protrude from the walls of the mold. Alternatively, the mold may be first packed with the larger particles and then the interstices between the larger particles filled with the smaller particles.

If the mold is packed with particles of different size in this manner, the final material contains a density of metallic carbide in the coating layer, which equals the density of sintered carbides having high percentages of binder. Compared to such sintered carbides, materials of this example are substantially lower in the cost and are more tougher. The economic advantage of this example is enhanced when scrap carbides are used. Titanium carbide scraps are particularly low in cost because of the inability of the more conventional matrixing techniques to wet the titanium particles. No difficulty is encountered in wetting the sintered titanium carbide particles when employing a method of this invention.

The alloy steel is heated to a temperature of about 200°–500° F. above its melting point which is sufficiently high to cause the molded metal to partially desinter the particulate hard metal. The temperature is maintained above the melting point for time sufficient to dissolve a substantial amount of the coarse carbide particles. The molten alloy is then allowed to solidify and the product which is produced has a surface layer which is highly concentrated in the metallic carbide and decreases in concentration toward the main body of the bit body with the center portion of the bit body being composed of substantially the alloy steel modified by a small amount of dissolved tungsten or titanium.

EXAMPLE III

In this example, the mold is packed with coarse particles of sintered tungsten carbide. The surface area is packed with particles of about of 1/16 inch mesh size and may include particles as large as ¼ inch mesh. The coarse tungsten carbide is packed around the entire surface area of the mold and surrounds the soft steel plugs. The Interior of the mold is packed with fine particles of alloy steel. The mold is then placed in a high frequency induction coil and heated to approximately 2900° F. After about thirty five seconds at this temperature, the heat cycle is then discontinued and the molded part is allowed to cool to room temperature.

The heating time depends on the exact configuration of the mold wall and the packing of the particles but will continue until the particles of large size have been degraded about 20–60%. The controlled degradation of the larger sintered particles, as well as the solution of the smaller particles into the steel results in a smooth surface. The sintered particles are metallurgically bonded in the composite and do not separate under abrasive forces encountered in drilling. The drill bit body is then heat treated to obtain the desired tensile strength. The tungsten carbide layer forming the surface of the drill bit body has a hardness of about RC 70 to 90.

ANOTHER EMBODIMENT OF THE INVENTION

Figure 16:
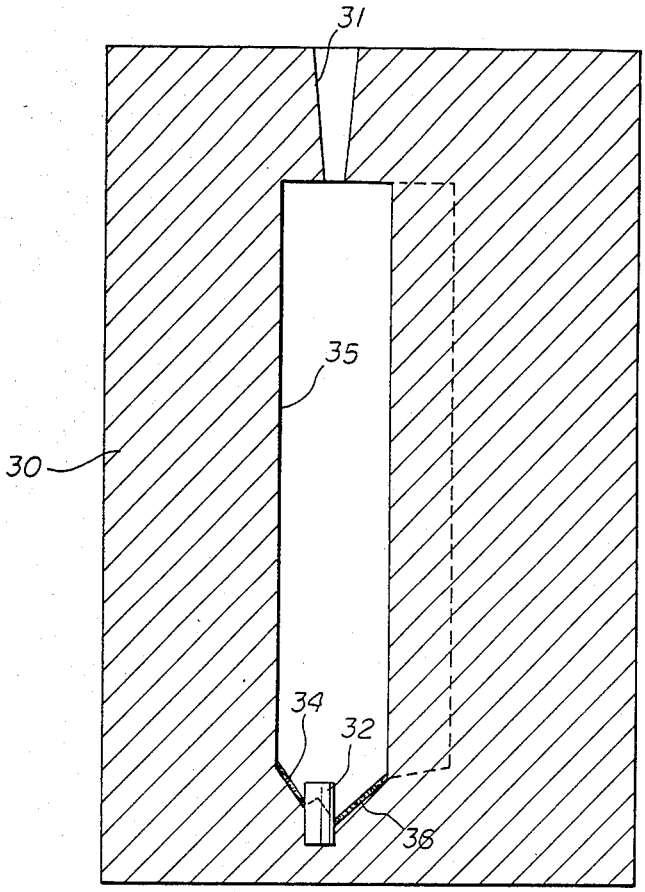
FIG. 16 is a section of the mold of FIG. 15 in a plane normal to the section shown in FIG. 15.

In FIGS. 6–14 there is shown a drag blade bit which may be made in accordance with this invention. In FIGS. 15 and 16 the mold is shown in which the bit blades are cast. This drag blade bit is shown and described in more detail in co-pending application Ser. No. 489,934, filed Apr. 29, 1983.

Figure 6:
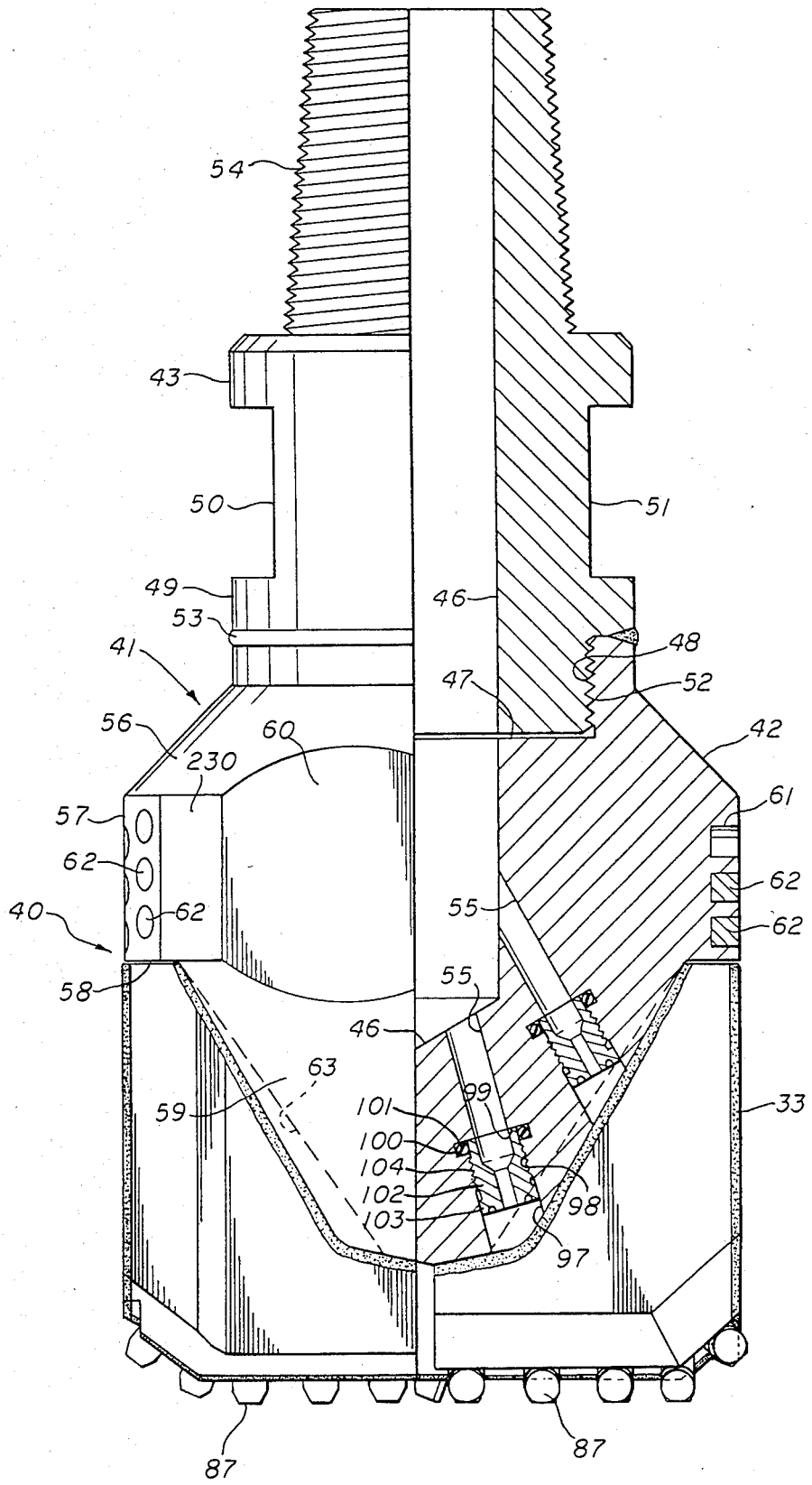
FIG. 6 is a view in side elevation of a drag blade bit having cutter blades prepared in accordance with this invention.
Figure 7:
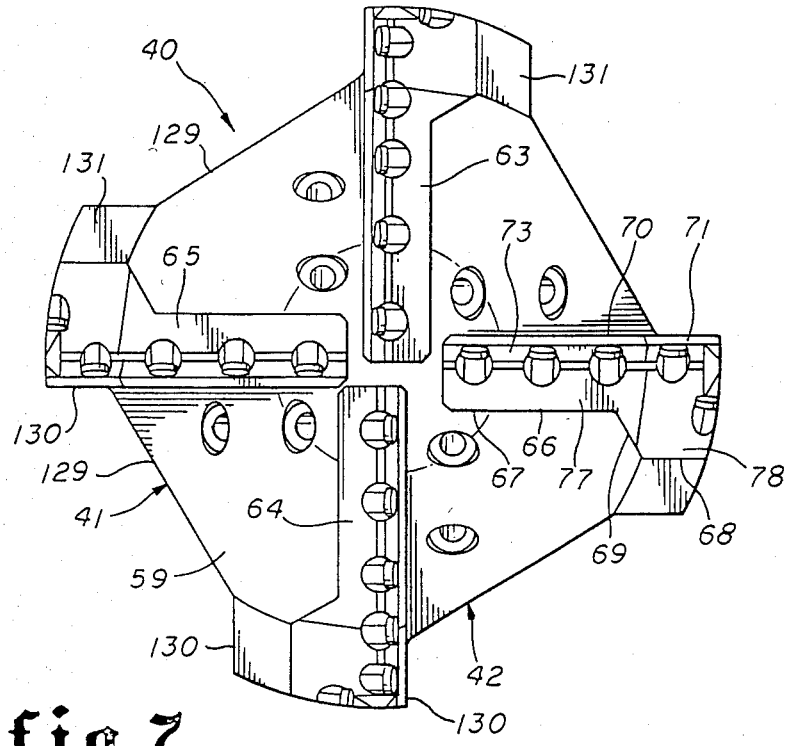
FIG. 7 is a bottom end view of the drag blade bit of FIG. 6.

In FIGS. 6 and 7, there is shown a drag blade bit 40 having a bit body 41 consisting of bit head 42 and threaded sub 43. The bit body 41 is cast and machined from a high temperature steel alloy. Bit head 42 has an internal cavity 44 defined by passage 45 and end wall 46. Cavity 44 is therefore closed at one end and open at the other end where it communicates with longitudinal passage 46 in connection sub 43. The open end portion of bit head 42 has a counterbore 47 which is internally threaded as indicated at 48. Connection sub 43 has a cylindrical outer surface 49 provided with slots 50 and 51 for receiving tongs or wrenches or the like. The lower end of connection sub 43 is of reduced diameter and threaded as indicated at 52 where it is threadedly secured in the threaded opening 48 in bit head 42. When the connection sub 43 is threadedly secured in place, it is welded as indicated at 53 to bit head 42 to produce a unitary bit body 41. The other end of connection sub 43 is provided with a tapered threaded portion 54 for connection to a drill collar.

Bit body 41 has a plurality (preferably eight) of passages 55 opening from interior cavity 44 through end wall 46 for flow of drilling fluid used for flushing cuttings from the well bore and cooling the cutting surfaces of the bit. The exterior surface of the bit head 42 comprises a bevel or conical surface 56 leading to a cylindrical peripheral surface 57 terminating in a peripheral shoulder 58 from which there extends a tapered or conical end portion 59.

A plurality of large surface grooves or junk slots 60 extend through the cylindrical outer surface 57 at spaced intervals around the periphery thereof. Junk slots 60 have a flat back wall 129 and tapered flat side walls 130. Junk slots 60 provide for passage of drilling fluid and cuttings from the well bore away from the cutting area. Junk slots 60 divide the peripheral surface 57 into a plurality of separate shoulders 131. Cylindrical surface 57 has a plurality of recesses 61 (FIG. 6) in which there are positioned inserts 62 of sintered tungsten carbide or equivalent hard facing material. The conical end portion 59 of bit head 42 has a plurality of slots 63 equally spaced and corresponding in number to the blades to be inserted in the bit.

Figure 8:
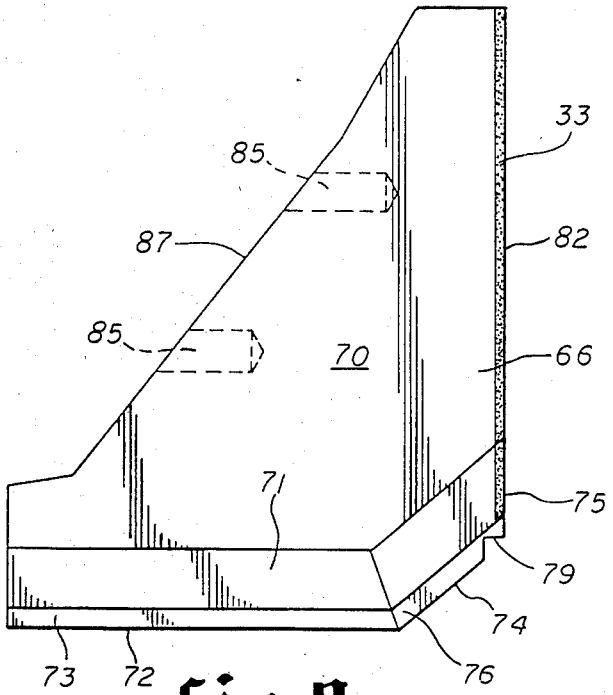
FIG. 8 is a view in side elevation of one of the bit blades of the drag blade bit of FIG. 6.
Figure 9:
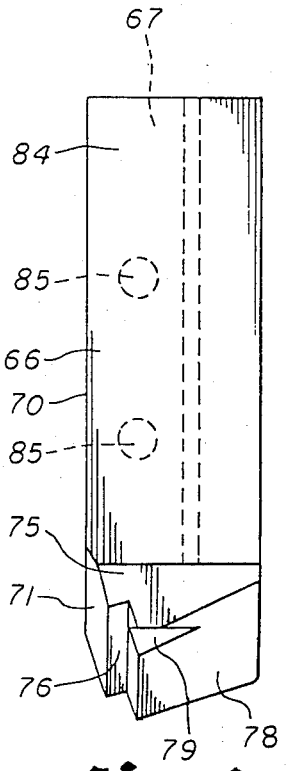
FIG. 9 is a view in end elevation of the drag bit blade of FIG. 8.
Figure 10:
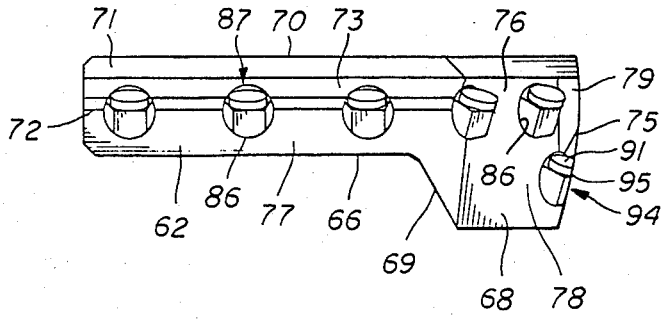
FIG. 10 is a bottom end view of the drag bit blade of FIG. 6.

The bottom face of blade bit 40 is shown in FIG. 7. In this view, a plurality of blade members are secured on conical end portion 59 of bit head 42. Two of the blade members 63 and 64 extend almost to the center line of the bit. The other blade members 65 and 66 are slightly shorter. Blade members 65 and 66 are substantially the same as bland members 63 and 64 except for their shortened length and that they have each one less cutter element. Details of blade member 66 are shown in FIGS. 8, 9 and 10.

Blade member 66 has a narrower flat blade portion 67 and wide end portion 68 joined by a bevelled shoulder 69. The front face 70 of blade member 66 has a bevelled surface 71 extending along the outer edge or cutting edge portion 72. A groove 73 extends along the length of cutting edge 72. At the outer or peripheral portion of blade member 66 the cutting edge is bevelled as at 74 extending out to the outer peripheral surface 75. The groove 73 continues as an inclined groove 76 following the bevel 74 toward the outer peripheral surface 75. At the cutting edge 72 of blade member 66 there is a rearwardly extending bevelled surface 77 which joins and merges into bevelled surface 78 on the wide end portion 68. A notch 79 extends from front to back as shown in FIGS. 8 and 9, to provide for flow of drilling fluid between the front and back faces of the blade members.

A layer of hard facing 33 is cast into the outer face of blade member 66. The outer surface 82 of hard facing 33 is a continuation of peripheral surface 75. The hard facing material 33 is preferably sintered tungsten carbide, although other conventional hard facing materials which may be cast in place could be used.

The narrower portion 67 of blade member 66 has a pair of recesses 85 which receive dowels for holding the blade member in place during welding to the bit body. When blade member 66 is positioned on bit head 42 it is positioned in one slot 63 with dowels (not shown) fitting into recesses in the bit head and recesses 85 in the blade member. This holds the blade members in a selected, fixed position during welding of the blade member to the bit head.

A plurality of recesses 86 are drilled in the cutting edge portions 72 and 74 in notches 73 and 76 to receive diamond cutters 87. Cutters 87 may be of the Stratapax type manufactured by General Electric Company or may be equivalent cutters made by other suppliers. Stratapax cutters are described in Daniels U.S. Pat. No. 4,156,329, Rowley U.S. Pat. No. 4,073,354 and in considerable detail in the book Advanced Drilling Techniques by William C. Maurer.

Diamond cutters 87 consist of a cylindrical supporting stud 88 of sintered carbide. Stud 88 has an angled surface 89 which is tapered at the same angle as bevelled surface 71. The top of stud 88 is tapered to the back as indicated at 90. A disc shaped cutting element 91 is bonded on angled surface 89, preferably by brazing or the like. Disc shaped cutting element 91 is a sintered carbide disc having a cutting surface 92 comprising polycrystalline diamond.

Figure 11:
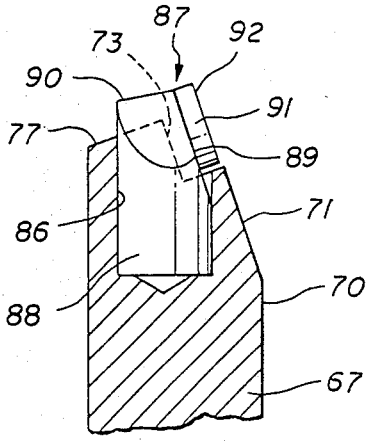
FIG. 11 is a sectional view through one of the bit blades showing one of the diamond cutter inserts in place.
Figure 12:
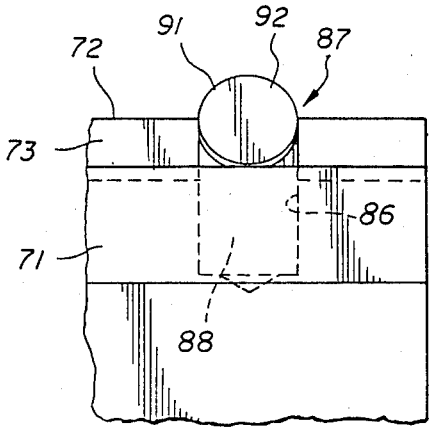
FIG. 12 is a view in elevation of a portion of the bit blade showing the diamond cutter insert in place.

In FIGS. 10 and 11, it is seen that cutting element 87 has stud 88 positioned in recess 86 so that cutter disc 91 abuts the bottom edge of notch 73 while the back edge of notch 73 provides added support for the stud 88 against flexure. A layer 34 of hard facing material is cast into the cutting edge portion 72 of the blade members between the cutters 87 to provide added wear protection. This hard facing, together with the hard facing layer 33, protects the blade members against wear during drilling operation. These layers of hard facing are cast into the blade by the process of this invention as described below.

Figure 13:
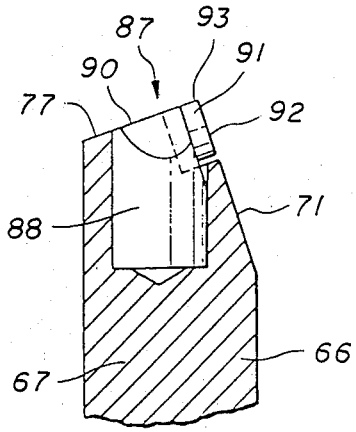
FIG. 13 is a sectional view of one of the bit blades showing a different embodiment of the diamond cutter insert.
Figure 14:
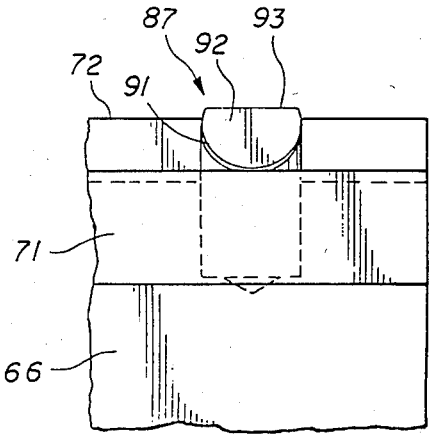
FIG. 14 is a view in elevation of a portion of the bit blade showing the diamond cutter insert of FIG. 13.
Figure 15:
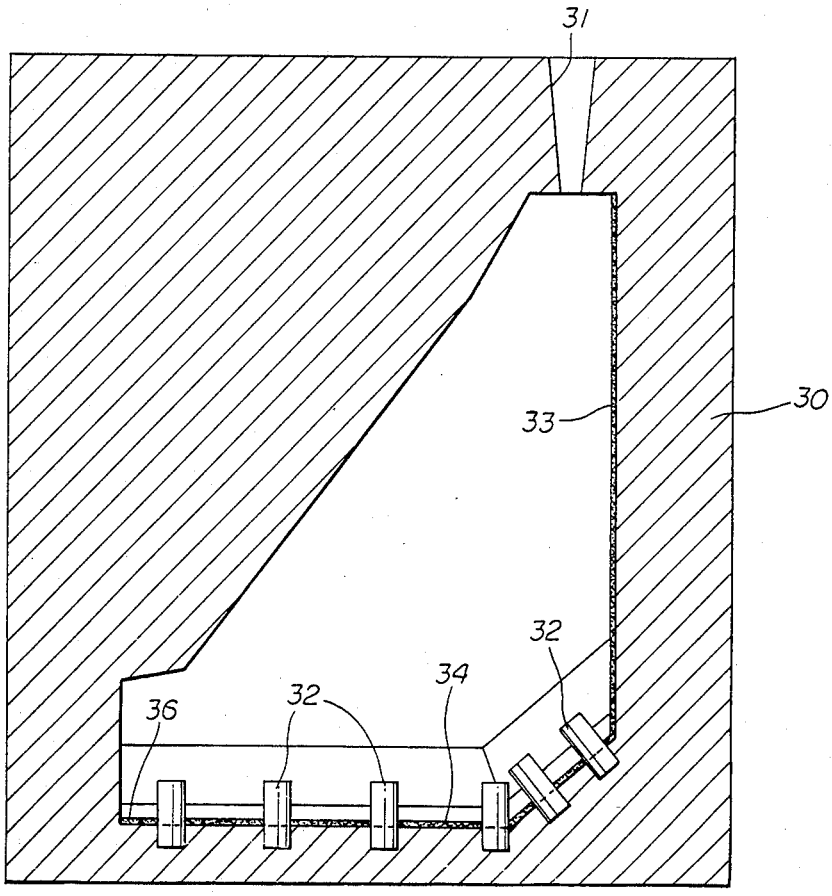
FIG. 15 is a sectional view of a mold for casting the bit blades shown in FIGS. 6–14.

In FIGS. 13 and 14 there is shown an alternate embodiment of the cutters 87. In this embodiment, cutter disc 91 is cut off along chord line 93 which is flush with end surface 90 of stud member 88 and is also flush with the bevelled surface 77 of the cutting edge portion of the blade member. This arrangement partially recesses the cutting element so that the chord edge 93 represents the cutting surface which is available for cutting with a scraping action. The cutting edge 93 extends only slightly beyond the edge portion 72 of blade member 66.

The outermost and rearmost cutter 94 has the cutter disc cut along an edge 95 which provides a flat cutting surface which is a continuation of the peripheral edge surface 75 of blade member 66. Cutter 94 is a gage cutter which extends only slightly beyond the gage surface of the blade member.

In the embodiment of FIG. 6, passages 55 open outwardly through end wall 46 of bit head 42 for discharging drilling fluid adjacent to the blade members. Passages 55 are designed to receive replaceable nozzles of any suitable, commercially available design. The nozzles are preferably constructed according to U.S. Pat. No. 4,381,825, co-pending with this application.

Nozzle passages 55 are counterbored at their outer ends to a slightly larger diameter as indicated at 97. There is an intermediate portion of slightly smaller diameter which is threaded as indicated at 98 and terminates in a shoulder 99 adjacent to passage 55. A peripheral groove 100 surrounds the nozzle passage adjacent to shoulder 99 and receives a sealing O-ring 101. Nozzle member 102 is formed of tungsten carbide and has a flange 103 which fits snugly in counterbore 97. Nozzle member 102 has a portion of reduced diameter behind flange 103 on which there is positioned a sleeve (not shown) in which there are formed threads 104 which allow for the nozzle to be secured in the passage thread 98.

Details of this nozzle member are shown in U.S. Pat. No. 4,381,825. The nozzle members 102 are easily installed and replaced for either field or factory service. The innermost end of the nozzle member 102 abuts against shoulder 99 and is sealed by O-ring 101. If desired, a sealing ring may be pressed fitted against the nozzle member 102 to resist any tendency of the nozzle member to become unscrewed. A sealing ring of this type also provides some protection against wash out of metal on the edges of the counterbore 97.

CASTING THE DRAG BIT BLADES

In FIGS. 15 and 16, there is shown a mold 30 into which the bit blade 64 is cast. Mold 30 has hollow cavity 35 which has an internal configuration corresponding to the bit blade 64. The bottom 36 of mold 30 has a configuration corresponding to the cutting edge of blade 64. A plurality of relatively soft metal plugs 32, e.g. a soft or mild steel, are positioned in the side an bottom walls of the mold cavity in locations corresponding to the recesses 86 in the edge notch which receive the cutting inserts 87. The mold cavity is coated with a thick layer 33 of a particulate hard facing material. The particulate material is of a sintered hard metal, e.g. fine or coarse particles of sintered tungsten carbide, and is provided as a thick coating or packing around the side wall of the mold cavity. A further coating 34 of tungsten carbide particles covers the bottom wall 36 of the cavity and surrounds various steel inserts 32.

The metal for bit blade 64, which is preferably an alloy steel, is melted and brought to a temperature about 200° above its melting point which is sufficient to melt the matrix metal of the sintered hard metal particles which form the layers 33 and 34 inside the mold cavity. When the molten metal is poured into the mold cavity it fills the cavity to produce a casting which corresponds precisely to the required dimensions of the bit blade 64. Alternatively, the metal for the bit blade 64 may be provided as a metal powder and melted in place by induction heating.

The portion of the molten metal which contacts the layers 33 and 34 of particulate sintered hard metal, e.g. sintered tungsten carbide, causes the matrix metal to partially melt and alloy with the molten metal to form the bit blade. The layer 33 and 34 of particulate hard metal therefore become an integral part of and form a composite structure with the bit body. This layer of particulate hard metal extends for an appreciative depth into the outer gage surface and the cutting edge surface of the bit blade and provides surfaces which are wear resistant for a long period of use of the resulting blade in a drill bit. When the bit blade 64 is removed from the mold, it has the steel inserts or plugs molded in place. Because of the angular location of some of the steel plug inserts, it is necessary to break the mold apart to remove the casting. The layer 34 of particulate hard metal surrounds the soft steel plugs 32 but does not coat them. The soft steel plugs 32 therefore provide relatively soft openings through the hard layer 34 of particulate hard metal. The soft steel plugs 32 are then drilled out to provide recesses for the diamond insert cutters 87. The apertures which are formed in the bottom end face of bit blade 64 by drilling out steel plugs receive the diamond insert cutters 87.

In the examples below, the specific details are given of the materials used in casting the drill bit blade and in forming the coating of particulate hard metal 33 and 34, as well as some of the temperature conditions utilized in the casting. These examples follow generally the same procedure as described above for casting complete drill bit bodies except that the mold is shaped to cast a blade and the iron plugs are positioned only in the cutting edge of the blade. In this application, the term particulate hard metal or particulate sintered hard metal refers to any of the classes of materials called "hard metals" in the metallurgical literature. Hard metals are refractory compounds of heavy metals such as tungsten, tantalum, uranium, niobium, etc. In particular, the carbides, nitrides, silicides, oxides, and borides of these heavy metals have the refractory properties of hardness which cause the entire group to be known to metallurgists as hard metals. These materials are generally prepared in a finely particulate form bound by a suitable matrix metal, such as an iron group metal, viz. iron, cobalt or nickel. Sometimes, copper and silver have been used as a matrix metal for the hard metals. In carrying out this invention, the examples used primarily particulate, sintered tungsten carbide, but it should be understood that equivalent particulate forms of the other hard metals could be used.

In the following example, it should be noted that tungsten carbide will dissolve in any iron alloy at 2650° F. or higher, which is the practical sintering temperature. Accordingly, while the alloy has a temperature above about 2650° F. when it has infiltrated the particles, the surfaces of the particles will dissolve into the alloy and fuse therein. This dissolving continues until the matrix cools below 2650° F. or the sintered material is completely dissolved. In this example, it is necessary to use tungsten carbide particles having a volume in surface areas such that they will not be completely dissolved before the matrix solidifies. This may involve the use of some larger sintered particles in the mold which only partially dissolve before the matrix solidifies. Alternatively, a larger quantity of smaller particles may be used which only dissolve partially before the casting alloy solidifies.

EXAMPLE IV

In this example, mild steel plugs are placed in the mold as described in connection with FIGS. 15 and 16. Next, 20/30 mesh sintered tungsten carbide particles are coated around the entire inner surface of the mold cavity with a coating surrounding the various mild steel plugs. Sufficient alloy steel to fill the mold cavity is then melted and heated to a temperature of about 3100° F. (temperatures in the range from 2800° to 3200° F. may be used) and poured into the molds. The mold is a sand mold (graphite molds may also be used) and at room temperature at the time of casting. The mold is filled with the molten alloy steel and allowed to cool naturally for about one (1) hour. Afterward, the mold is broken away from the casting and the casting subsequently quenched and then tempered.

The surface coatings 33 and 34 of the casting which comprises the bit blade 64 are of sintered particles of tungsten carbide which are a fine particle size as a result of partially dissolving into the molten metal of the bit body. The metal matrix which extends between the individual tungsten carbide particles is an alloy steel containing additional tungsten and carbon from the composition of some of the tungsten carbide and a small amount of the matrix metal, which here is cobalt. When the steel plugs 32 are drilled out as described above, the various components of the drill bit may be placed in their desired location and the finished drill bit thus produced.

The drill bit blade which is produced in this example has the strength and high temperature properties of the alloy steel in the main body portion thereof. The gage and cutting edge surface layers have the properties of the fine particles of tungsten carbide with the matrix alloy extending throughout the spaces between the tungsten carbide particles. The overall structure is a composite which varies in construction from the surface layer which is primarily tungsten carbide particles through somewhat varying composition which becomes progressively more dilute and joins into the main body portion which is alloy steel modified by a small amount of dissolved tungsten. The surface of the bit body will typically have a hardness of 70–90 RC.

While the process has been described as using ordinary commercially available tungsten carbide particles, it should be noted that the carbides used may also be reclaimed carbides from spent or used hard metal products. For example, sintered carbide cutters, inserts and the like can be crushed to a coarse powder and used as the coating material. This carbides may include carbides of tantalum, titanium, or the like as well tungsten carbides. When coarser carbide particles are used, it is usually necessary to heat the molten alloy steel to a somewhat higher temperature so that more of the carbide particles will be dissolved before the steel solidifies.

EXAMPLE V

In this example, the mold is coated with a mixture of coarse particles of sintered tungsten carbide obtained by reclaiming scrap cutter inserts and fine particles of sintered tungsten carbide. The tungsten carbide particles are packed into a substantial layer around the entire inner surface of the mold and surrounding the mild steel plugs which protrude from the walls of the mold. Alternatively, the mold may be first packed with the larger particles and then the interstices filled with the smaller particles.

If the mold is packed with particles of different size in this manner, the final material contains a density of metallic carbide in the coating layer, which equals the density of sintered carbides having high percentages of binder. Compared to such sintered carbides, materials of this example are substantially lower in the cost and are more tougher. The economic advantage of this example is enhanced when scrap carbides are used. Titanium carbide scraps are particularly low in cost because of the inability of the more conventional matrixing techniques to wet the titanium particles. No difficulty is encountered in wetting the sintered titanium carbide particles when employing a method of this invention.

The alloy steel is heated to a temperature of about 200°–500° F. above its melting point which is sufficiently high to cause the molded metal to partially desinter the particulate hard metal. The temperature is maintained above the melting point for time sufficient to dissolve a substantial amount of the coarse carbide particles. The molten alloy is then allowed to solidify and the product which is produced has a surface layer which is highly concentrated in the metallic carbide and decreases in concentration toward the main body of the bit body with the center portion of the bit body being composed of substantially the alloy modified by a small amount of dissolved tungsten or titanium.

EXAMPLE VI

In this example, the mold is packed with coarse particles of sintered tungsten carbide. The surface area is packed with particles of about of 1/16 inch mesh size and may include particles as large as ¼ inch mesh. The coarse tungsten carbide is packed around the entire surface area of the mold and surrounds the soft steel plugs. The Interior of the mold is packed with fine particles of alloy steel. The mold is then placed in a high frequency induction coil and heated to approximately 2900° F. After about thirty five seconds at this temperature, the heat cycle is then discontinued and the molded part is allowed to cool to room temperature.

The heating time depends on the exact configuration of the mold wall and the packing of the particles but will continue until the particles of large size have been degraded about 20–60%. The controlled degradation of the larger sintered particles, as well as the solution of the smaller particles into the steel results in a smooth surface. The sintered particles are metallurgically bonded in the composite and do not separate under abrasive forces encountered in drilling. The drill bit body is then heat treated to obtain the desired tensile strength. The tungsten carbide layer forming the surface of the drill bit body has a hardness of about RC 70 to 90.

USE OF CAST IRON OR NODULAR CAST IRON

In carrying out this process, the emphasis has been on casting the drill bit bodies from an alloy steel. One satisfactory alloy steel is a 4130 alloy steel, although other suitable alloy steels, particularly high temperature alloys can be used. In addition, in some instances, the bit body can be cast from cast iron, or nodular cast iron. The procedure and arrangement of the mold and inserts is the same except that the iron melts at a substantially lower temperature. When the process is used with cast iron, or nodular cast iron, the operating temperature is about 2400° F.

EXAMPLE VII

In this example, mild steel plugs are placed in the mold as described for FIG. 3. Next, 20/30 mesh sintered tungsten carbide particles are coated around the entire inner surface of the mold cavity with a coating surrounding the various mild steel plugs. Sufficient casting grade iron to fill the mold cavity is then melted and heated to a temperature of about 2800° F. (temperatures in the range from 2400° to 2900° F. may be used) and poured into the molds. The mold is a sand mold (graphite molds may also be used) and at room temperature at the time of casting. The mold is filled with the molten cast iron and allowed to cool naturally for about one (1) hour. Afterward, the mold is broken away from the casting and the casting subsequently quenched and then tempered.

The surface coating of the casting which comprises the bit body 2 is of sintered particles of tungsten carbide which are a fine particle size as a result of partially dissolving into the molten metal of the bit body. The metal matrix which extends between the individual tungsten carbide particles is an alloy steel formed from tungsten and carbon from the decomposition of some of the tungsten carbide and a small amount of the matrix metal, which here is cobalt. When the steel plugs are drilled out as described above, the various components of the drill bit may be placed in their desired location and the finished drill bit thus produced.

The drill bit body which is produced in this example has the strength and properties of cast iron in the main body portion thereof. The main surface layer has the properties of the fine particles of tungsten carbide with the matrix alloy extending throughout the spaces between the tungsten carbide particles. The overall structure is a composite which varies in construction from the surface layer which is primarily tungsten carbide particles through somewhat varying composition which becomes progressively more dilute and joins into the main body portion which is cast iron modified by a small amount of dissolved tungsten. The surface of the bit body will typically have a hardness of 70–90 RC.

While the process has been described as using ordinary commercially available tungsten carbide particles, it should be noted that the carbides used may also be reclaimed carbides from spent or used hard metal products. For example, sintered carbide cutters, inserts and the like can be crushed to a fairly coarse powder and used as the coating material. This carbides may include carbides of tantalum, titanium, or the like as well tungsten carbides. When coarser carbide particles are used, it is usually necessary to heat the molten alloy steel to a somewhat higher temperature so that more of the carbide particles will be dissolved before the steel solidifies.

EXAMPLE VIII

In this example, the mold is coated with a mixture of coarse particles of sintered tungsten carbide obtained by reclaiming scrap cutter inserts and fine particles of sintered tungsten carbide. The tungsten carbide particles attack into a substantial layer around the entire enter surface of the mold and surrounding the mild steel plugs which protrude from the walls of the mold. Alternatively, the mold may be first packed with the larger particles and then the interstices between the larger particles filled with the smaller particles.

If the mold is packed with particles of different size in this manner, the final material contains a density of metallic carbide in the coating layer, which equals the density of sintered carbides having high percentages of binder. Compared to such sintered carbides, materials of this example are substantially lower in the cost and are more tougher. The economic advantage of this example is enhanced when scrap carbides are used. Titanium carbide scraps are particularly low in cost because of the inability of the more conventional matrixing techniques to wet the titanium particles. No difficulty is encountered in wetting the sintered titanium carbide particles when employing a method of this invention.

The casting iron is heated to a temperature of about 200°-500° F. above its melting point which is sufficiently high to cause the molten metal to partially desinter the particulate hard metal. The temperature is maintained above the melting point for time sufficient to dissolve a substantial amount of the coarse carbide particles. The molten alloy is then allowed to solidify and the product which is produced has a surface layer which is highly concentrated in the metallic carbide and decreases in concentration toward the main body of the bit body with the center portion of the bit body being composed of substantially cast iron modified by a small amount of dissolved tungsten or titanium.

EXAMPLE IX

In this example, the mold is packed with coarse particles of sintered tungsten carbide. The surface area is packed with particles of about of 1/16 inch mesh size and may include particles as large as ¼ inch mesh. The coarse tungsten carbide is packed around the entire surface area of the mold and surrounds the soft steel plugs. The Interior of the mold is packed with fine particles of casting grade iron. The mold is then placed in a high frequency induction coil and heated to approximately 2800° F. After about thirty five seconds at this temperature, the heat cycle is then discontinued and the molded part is allowed to cool to room temperature.

The heating time depends on the exact configuration of the mold wall and the packing of the particles but will continue until the particles of large size have been degraded about 20–60%. The controlled degradation of the larger sintered particles, as well as the solution of the smaller particles into the molten iron results in a smooth surface. The sintered particles are metallurgically bonded in the composite and do not separate under abrasive forces encountered in drilling. The drill bit body is then heat treated to obtain the desired tensile strength. The tungsten carbide layer forming the surface of the drill bit body has a hardness of about RC 70 to 90.

While this invention has been described fully and completely with special emphasis on several preferred embodiments, it should be understood that within the scope of the appended claims the invention may be practiced otherwise than as specifically described herein.

I claim:

1. A method of producing a drill bit component adapted to receive a plurality of hardmetal inserts positioned in recesses therein, which comprises providing a refractory mold having an internal surface corresponding closely to the external shape of a finished drill bit component and having a plurality of relatively soft metal plugs protruding from the walls thereof in locations corresponding to the recesses in the bit component in which said inserts are to be positioned, supporting a coating of sintered refractory metal particles on selected portions of the inner surface of said mold including the locations where said soft metal plugs are positioned, melting a metal and heating the same above the melting point of the matrix metal of said refractory metal particles, casting said molten metal into said mold in contact with said refractory metal particles to produce some desintering of said particles and produce a casting having a composite structure with selected portions of the surface being coated with said particles for a substantial depth and with said soft metal plugs extending through said coating, removing said casting from said mold, drilling out said metal plugs from said casting to produce recesses in said bit component sized to receive said inserts, and placing said inserts in said drilled recesses.

2. A method according to claim 1 in which said bit component comprises a hollow bit body with a plurality of cutting inserts and wear inserts positioned in recesses in said body, said refractory mold has an internal configuration corresponding closely to the external configuration of a finished bit body and has a plurality of relatively soft metal plugs protruding from the walls thereof in locations corresponding to the recesses in the bit body in which said cutting inserts and wear inserts are to be positioned, and placing wear inserts in selected drilled recesses and cutting inserts in other selected drilled recesses.

3. A method according to claim 2 in which said refractory metal particles comprise particles of sintered tungsten carbide.

4. A method according to claim 3 in which said sintered tungsten carbide particles are bonded by a matrix comprising an iron group metal.

5. A method according to claim 2 in which said molten casting metal is maintained at a temperature sufficient to desinter said particles for a time sufficient to reduce the particles to a predetermined smaller size and then cooling below the solidification temperature.

6. A method according to claim 2 in which said casting metal is heated to about 2600°-3200° F.

7. A method according to claim 2 in which said casting metal is iron, nodular iron or steel.

8. A method according to claim 2 in which said particles are coated over substantially the entire inner surface of said mold and surround said metal plugs.

9. A drill bit produced by the method of claim 2.

10. A method according to claim 1 in which
said bit component comprises a drag bit blade having a plurality of cutting inserts positioned in recesses in a cutting edge portion thereof, and having a gage wear surface with a wear resistant coating thereon,
said refractory mold has an internal configuration corresponding closely to the external configuration of a finished bit blade and has a plurality of relatively soft metal plugs protruding from the walls thereof in locations corresponding to the recesses in the bit body in which said cutting inserts are to be positioned, and
placing cutting inserts in said drilled recesses.

11. A method according to claim 10 in which
said mold is coated with said sintered refractory metal particles on the surface defining the gage surface of the casting.

12. A method of producing a drill bit body with a plurality of recesses and passages for receiving drill bit components and the external surface thereof coated with an integrally formed layer of a refractory hard metal, which comprises
providing a refractory mold having an internal configuration corresponding closely to the external configuration of a finished bit body and having a plurality of relatively soft metal plugs protruding from the walls thereof in locations corresponding to the recesses in the bit body in which said drill bit components are to be positioned,
supporting a coating of sintered refractory metal particles on the inner surface of said mold,
melting a metal and heating the same above the melting point of the matrix metal of said refractory metal particles,
casting said molten metal into said mold in contact with said refractory metal particles to effect at least a partial desintering of said particles and produce a casting having a composite structure with the surface being coated with said particles for a substantial depth and with said soft metal plugs extending through said coating,
removing said casting from said mold, and
drilling out said metal plugs from said casting to produce recesses in said body sized to receive said drill bit components.

13. A method according to claim 12 in which
said refractory metal particles comprise particles of sintered tungsten carbide.

14. A method according to claim 13 in which
said sintered tungsten carbide particles are bonded by a matrix comprising an iron group metal.

15. A method according to claim 12 in which
said molten casting metal is maintained at a temperature sufficient to desinter said particles for a time sufficient to reduce the particles to a predetermined smaller size and then cooling below the solidification temperature.

16. A method according to claim 12 in which
said casting metal is heated to about 2600°-3200° F.

17. A method according to claim 12 in which
said casting metal is iron, nodular iron, or steel.

18. A method according to claim 12 in which
said particles are coated over substantially the entire inner surface of said mold and surround said metal plugs.

19. A drill bit body produced according to claim 12.

20. A method of producing a shaped metal body with a plurality of recesses and passages and the external surface thereof coated with an integrally formed layer of a refractory hard metal not extending into said recesses and passages, which comprises
providing a refractory mold having a selected internal configuration and having a plurality of relatively soft metal plugs protruding from the walls thereof in locations corresponding to the recesses and passages in said shaped body,
supporting a coating of sintered refractory metal particles on the inner surface of said mold,
melting a metal and heating the same above the melting point of the matrix metal of said refractory metal particles,
casting said molten metal into said mold in contact with said refractory metal particles to effect at least a partial desintering of said particles and produce a casting having a composite structure with the surface being coated with said particles for a substantial depth and with said soft metal plugs extending through said coating,
removing said casting from said mold, and
drilling out said metal plugs from said casting to produce recesses and passages in said body of selected sizes and locations.

21. A shaped metal body produced by the method of claim 20.

22. A drag bit blade produced according to claim 10.

* * * * *